US005441289A

United States Patent [19]

Spielberger

[11] Patent Number: 5,441,289

[45] Date of Patent: Aug. 15, 1995

[54] CONVERTIBLE WALKER/VEHICLE FOR A CHILD

[75] Inventor: Lee Spielberger, Warwick, R.I.

[73] Assignee: Hasbro, Inc., Pawtucket, R.I.

[21] Appl. No.: 331,395

[22] Filed: Oct. 28, 1994

[51] Int. Cl.[6] ..... B62B 7/12; B62B 7/14

[52] U.S. Cl. ..... 280/87.051; 280/648; 280/655.1; 280/47.371; 135/67; 297/6; 297/118; 297/183.3; 446/451; 446/471; D12/130; D21/136; 482/68

[58] Field of Search ..... 280/648, 650, 658, 655.1, 280/47.36, 47.371, 47.38, 87.051; 135/66, 67, 74; 297/6, 118, 183.3; 446/451, 470, 471; 482/67, 68, 69; D12/130; D21/134, 136, 137

[56] References Cited

U.S. PATENT DOCUMENTS

| | | | |
|---|---|---|---|
| D. 238,595 | 1/1976 | Goldfarb . | |
| 257,185 | 5/1882 | Price | 482/68 |
| D. 264,107 | 4/1982 | Orenstein . | |
| D. 266,008 | 8/1982 | Klawitter | D21/136 X |
| D. 268,405 | 3/1983 | Hanses et al. | D12/130 |
| D. 292,108 | 9/1987 | Bollinger et al. . | |
| D. 305,555 | 1/1990 | Spielberger . | |
| D. 311,760 | 10/1990 | Harrod . | |
| D. 312,488 | 11/1990 | Kwan . | |
| D. 328,479 | 8/1992 | Wakimura | D21/136 |
| 1,448,783 | 3/1923 | Blewitt et al. | 482/68 X |
| 5,154,658 | 10/1992 | Marcus . | |
| 5,261,690 | 11/1993 | Kluber | 280/648 |
| 5,362,272 | 11/1994 | Chow et al. | 280/47.38 X |
| 5,383,808 | 1/1995 | DuBois | 446/451 X |

FOREIGN PATENT DOCUMENTS

| | | | |
|---|---|---|---|
| 2640154 | 6/1990 | France | 280/87.051 |
| 0432432 | 10/1948 | Italy | 482/68 |
| 4-071554 | 3/1992 | Japan | 135/67 |

*Primary Examiner*—Brian L. Johnson
*Attorney, Agent, or Firm*—Kurt R. Benson

[57] ABSTRACT

A walker/vehicle for a child includes a U-shape chassis member which is movably supported on a plurality of wheels and a frame member including spaced, transversely extending, seat and handle bar portions and a pair of side connector portions extending therebetween. The frame member is adapted to be alternatively assembled with the chassis in a vertically extending first position in which the handle bar portion thereof provides a walker handle bar or a horizontally extending second position in which the seat portion thereof provides a vehicle seat.

9 Claims, 5 Drawing Sheets

CONVERTIBLE WALKER/VEHICLE FOR A CHILD

BACKGROUND AND SUMMARY OF THE INVENTION

The instant invention relates to walkers for toddler age children and more particularly to a walker which is convertible to a foot-to-floor ride-on vehicle.

It is widely recognized that walkers can be effective in accelerating the development of walking skills in toddler age children, and accordingly, a relatively large number of different types of walker apparatus have been heretofore available. However, because of the relatively short attention spans of most toddler-age children, it has been found that it is often advantageous for walkers to also incorporate various amusement elements, such as noisemakers and the like. For example, the walker disclosed in the Marcus, U.S. Pat. No. 5,154,658, which includes a motion actuated sound and light module, has been found to have an increased level of appeal.

Despite the well documented benefits derived from utilizing walkers for aiding in the development of walking skills in toddler age children, the actual period of time during which a walker is used by a child in the development of his or her walking skills can be relatively short. Therefore, in many cases, unless a walker can be passed on to another child, the period during which it can be effectively used can be quite limited.

The instant invention provides an effective apparatus which is adapted to be alternatively used as a walker or as a foot-to-floor ride-on vehicle, and which therefore has a substantially increased period of usefulness in the development and growth of a child. Further, the walker assembly of the instant invention is adapted to include a variety of different amusing vehicle-like components which are effective for extending the attentive period during which a child is likely to use the apparatus at any given time. Accordingly, the walker/vehicle of the instant invention is adapted to provide enhanced effectiveness in its use as a walker, and it also has an increased overall useful life as a result of being convertible into a toy vehicle.

The convertible walker/vehicle of the instant invention comprises a chassis of general U-shaped configuration which is supported in a generally horizontal disposition on a plurality of wheels. The U-shaped chassis is adapted so that the closed or base end portion thereof defines the front end of a vehicle, so that the opposite legs or sides thereof define the sides of the vehicle, and so that the opposite or open end thereof defines the rear end of the vehicle. The apparatus further comprises a frame member including transversely extending handle bar and seat portions which are preferably connected by a pair of side connector portions so that the handle bar and seat portions cooperate with the connector portions for defining an enlarged open area in the frame member. The vehicle is adapted so that the frame member is alternatively securable in first or second positions on the chassis for use of the apparatus as a walker or as a toy vehicle, respectively. More specifically, when the frame member is received in the first position thereof on the chassis, the connector portions extend upwardly from the chassis for positioning the handle bar portion in upwardly spaced transverse relation thereto for use of the handle bar portion as a walker handle. When the frame member is in the first position thereof, the seat portion is preferably disposed adjacent the base portion of the chassis and the opposite legs of the chassis preferably have inwardly facing recesses for receiving the connector portions of the frame member therein so that the frame member is maintained in an upwardly extending disposition relative to the chassis. When the frame member is positioned in the second position thereof, the seat portion is positioned so that it extends between the leg portions of the chassis in rearwardly spaced relation to the base portion thereof for supporting a child on the seat portion. When the frame member is in the second position thereof, it is positioned in a substantially horizontal disposition, and the chassis preferably includes upwardly facing recesses on the leg portions thereof for receiving the frame member in the second position thereof. Further, the convertible walker/vehicle preferably includes a locking member on the chassis which is engageable with the frame member for releasably securing it in the first or second positions thereof. Still further, the walker/vehicle preferably includes a simulated dashboard and steering wheel assembly on the base portion of the chassis for enhancing the overall appeal of the apparatus to a young child.

It has been found that the convertible walker/vehicle of the instant invention represents a significant improvement over the heretofore available walker apparatus. Specifically, the device of the instant invention includes a frame member which is alternatively positionable on the chassis in an upwardly extending disposition in which the frame member provides a handle bar for use of the apparatus as a walker. Alternatively, the frame member is positionable in a generally horizontal disposition on the chassis, and in this position the frame member provides a convenient seat for a child so that the child can use the apparatus as a ride-on vehicle. Still further, it has been found that because the apparatus includes various accessories, such as a steering wheel and a dashboard, it has enhanced overall appeal to a young child.

Accordingly, it is a primary object of the instant invention to provide an effective apparatus which is alternatively operable as a walker for a toddler age child or as a ride-on vehicle.

Another object of the instant invention is to provide a convertible walker/vehicle comprising a generally U-shaped chassis and a frame member which is alternatively receivable in first and second positions on the chassis for use of the apparatus as a walker or as a ride-on vehicle, respectively.

Another object of the instant invention is to provide a walker having an increased overall useful life as a result of being convertible into a toy ride-on vehicle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
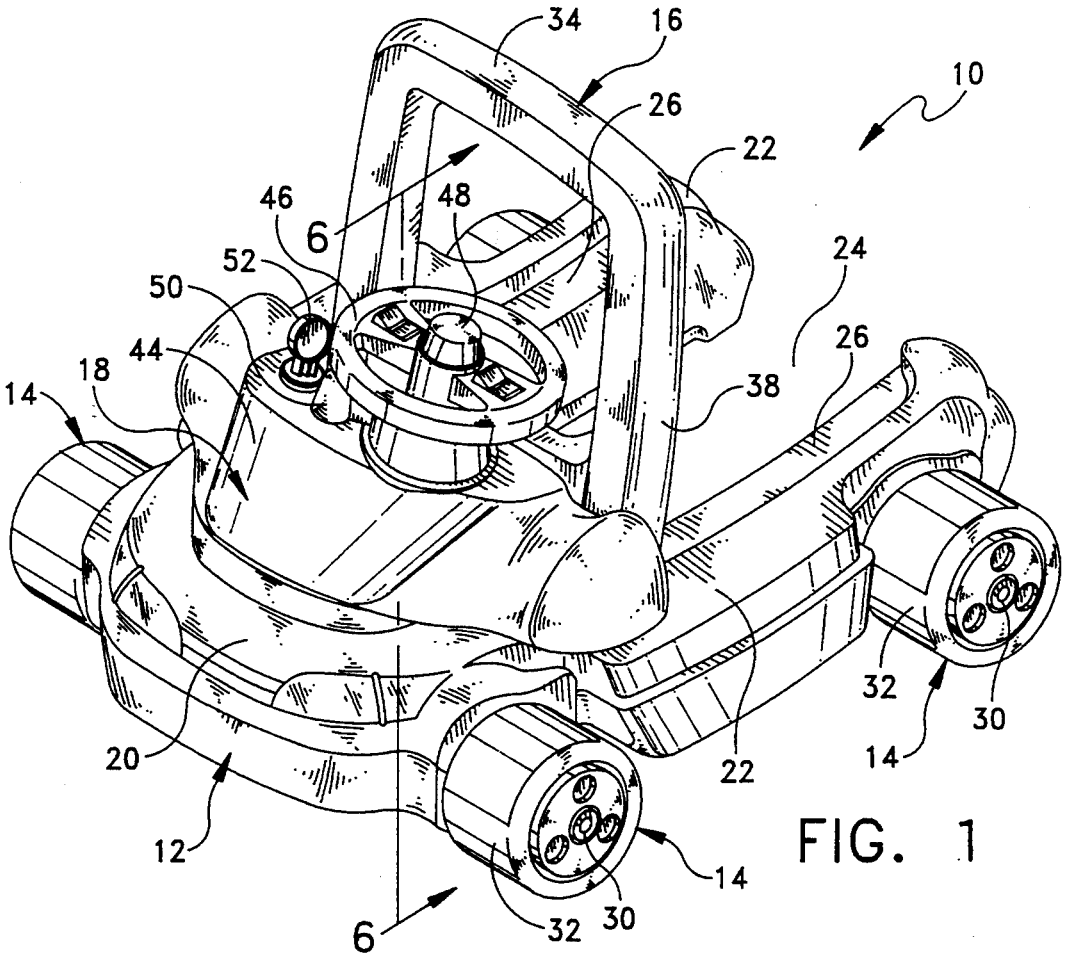
FIG. 1 is a perspective view of the convertible walker/vehicle of the instant invention with the frame member in the first position thereof.

Referring now to the drawings, the convertible walker/vehicle of the instant invention is illustrated in FIGS. 1–7, and generally indicated at 10 in FIGS. 1–5. The convertible walker/vehicle 10 comprises a chassis assembly generally indicated at 12, a plurality of wheels generally indicated at 14, a frame member generally indicated at 16, a dashboard assembly generally indicated at 18, and a retaining member 19. The frame member 16 and the chassis 12 are adapted to enable the frame member 16 to be alternatively assembled in the first position thereof illustrated in FIG. 1 or in the second position thereof illustrated in FIG. 2. As will be seen, when the frame member 16 is assembled in the first position thereof on the chassis 12, the frame assembly 16 provides an effective handle bar which enables the convertible walker/vehicle 10 to be utilized as a walker for aiding a toddler age child in the development of walking skills. Alternatively, when the frame member 16 is assembled in the second position thereof illustrated in FIG. 2, the frame assembly 16 provides a seating surface which enables the convertible walker/vehicle 10 to be effectively utilized as a foot-to-floor ride-on vehicle.

The chassis 12 is preferably integrally molded from a suitable durable plastic material in a generally U-shaped configuration. Accordingly, the chassis 12 includes a front or base portion 20 and a pair of opposite side or leg portions 22 which extend rearwardly from the base portion 20. The base portion 20 is preferably formed to resemble the front end of a fanciful vehicle, and the leg portions 22 extend rearwardly therefrom in spaced relation so that they cooperate with the base portion 20 to define an enlarged open area 24. The opposite leg portions 22 have upwardly opening elongated recesses 26 formed therein, and they also have upwardly opening forward recesses 28 formed therein adjacent the area where they merge with the base portion 20.

The wheel assemblies 14 each comprise an axle element 30 which is attached to the chassis 12 and a wheel element 32 which is rotatably received on the axle element 30 thereof and preferably integrally molded from a suitable plastic material. The wheel assemblies 14 are positioned proximal the four corners of the chassis 12 so that they are effectively capable of movably supporting the chassis 12 in a substantially horizontal disposition on a supporting surface.

The frame member 16 is preferably integrally molded in a generally rectangular configuration, and it includes transversely extending handle bar and seat portions 34 and 36, respectively, and a pair of side connector portions 38, which extend between the handle bar and connector portions 34 and 36, respectively. As illustrated, the handle bar and seat portions 34 and 36, respectively, cooperate with the connector portions 38 to define an enlarged center open area in the frame member 16. The seat portion 36 has a locking recess 40 formed on one side thereof, and it has a pair of support members 42 formed on the opposite side thereof.

The dashboard assembly 18 comprises a dashboard member 44, which is received and permanently secured on the base portion 20 of the chassis 12. The dashboard assembly 18 further comprises a rotatable steering wheel element 46 having a horn 48, a pivotable simulated turn signal element 50 and a rotatable simulated ignition key 52. As herein embodied, the steering wheel element 46, the turn signal element 50 and the ignition key 52 are actually nonfunctional, although the ignition key 52 preferably includes a noisemaker component.

The locking member 19 comprises a rotatably mounted arm or latching element which is mounted on the underside of the dashboard member 44 so that it is engageable with the frame member 16 for alternatively securing the frame member 16 in the first or second positions thereof as will hereinafter be more fully set forth.

Figure 2:
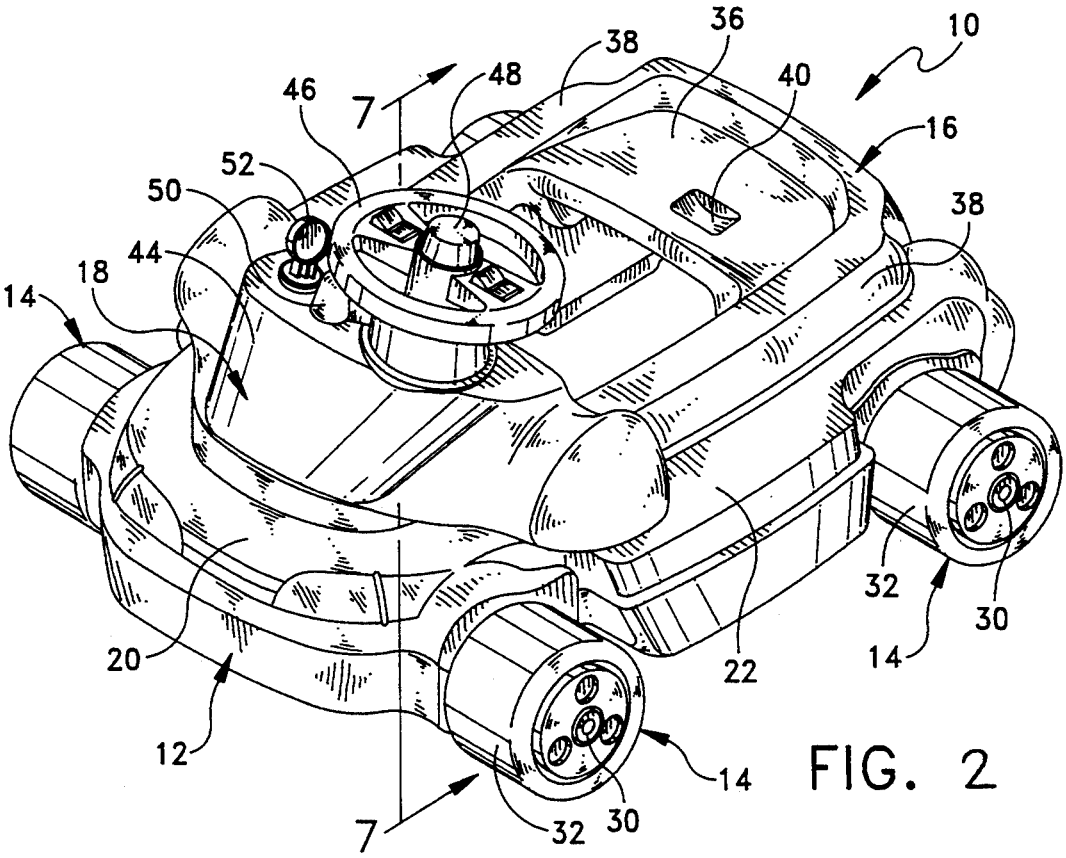
FIG. 2 is a perspective view thereof with the frame member in the second position thereof.
Figure 3:
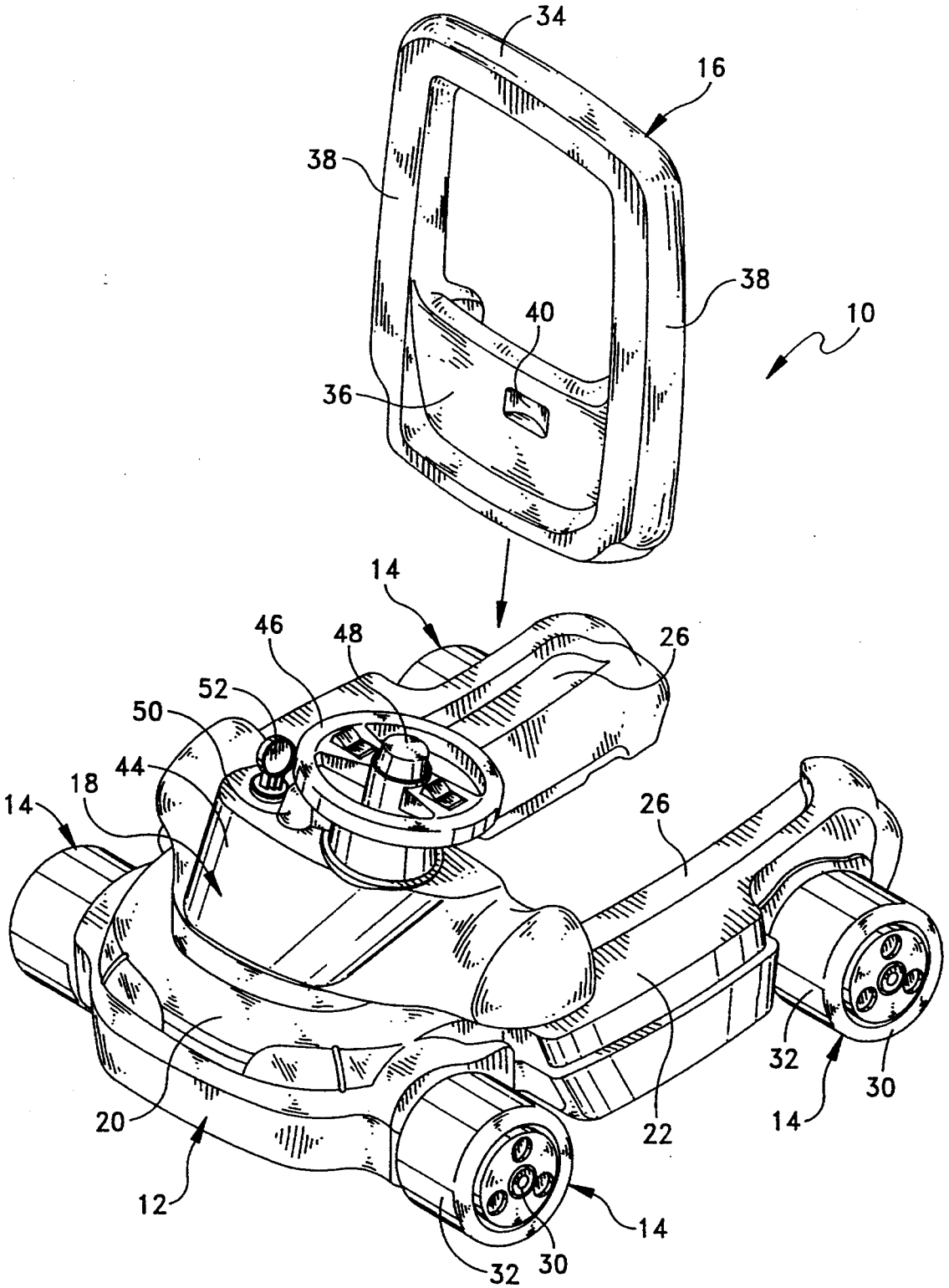
FIG. 3 is an exploded perspective view illustrating the assembly of the frame member into the first position thereof.
Figure 4:
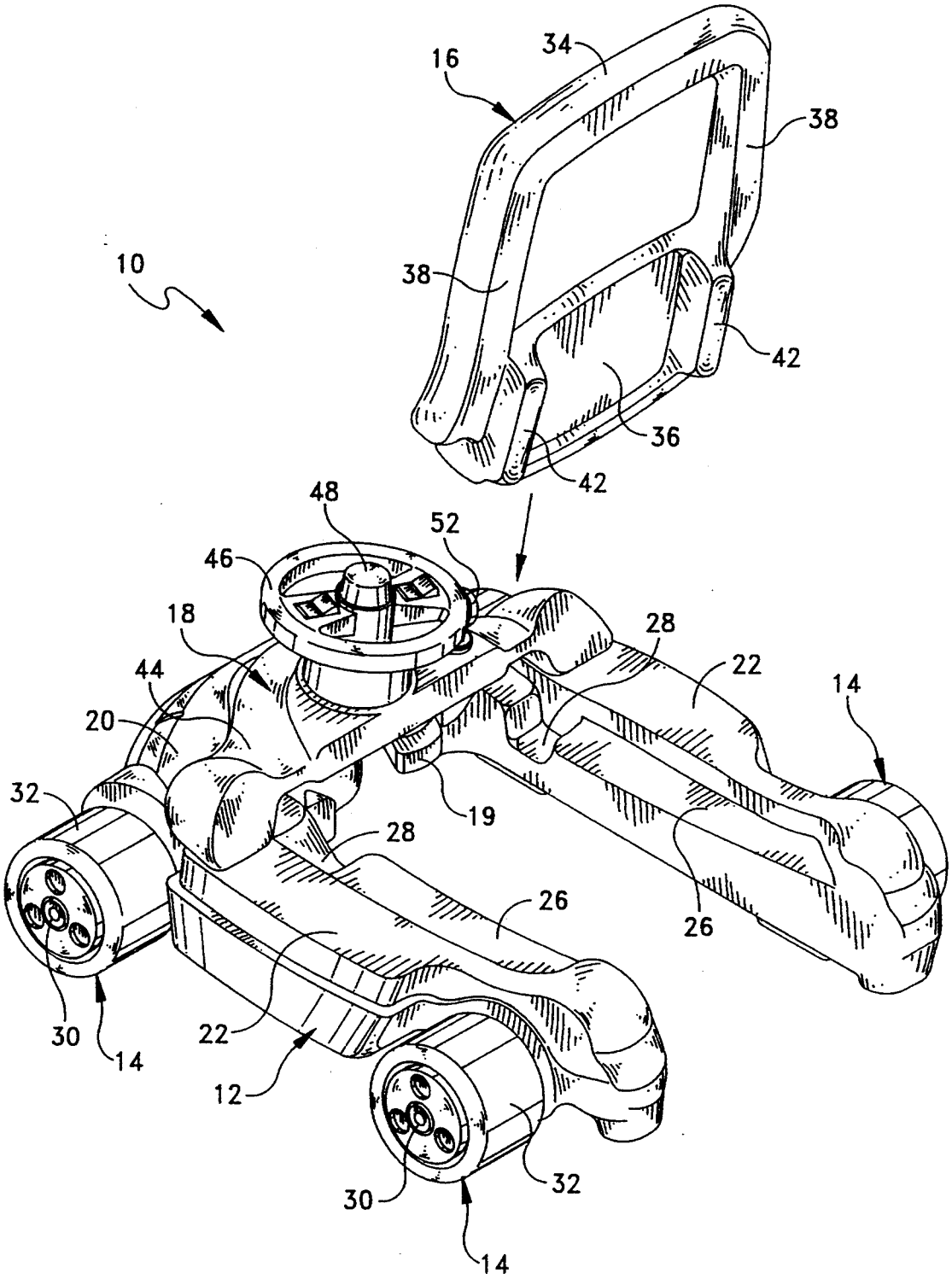
FIG. 4 is a similar rear perspective view thereof.
Figure 5:
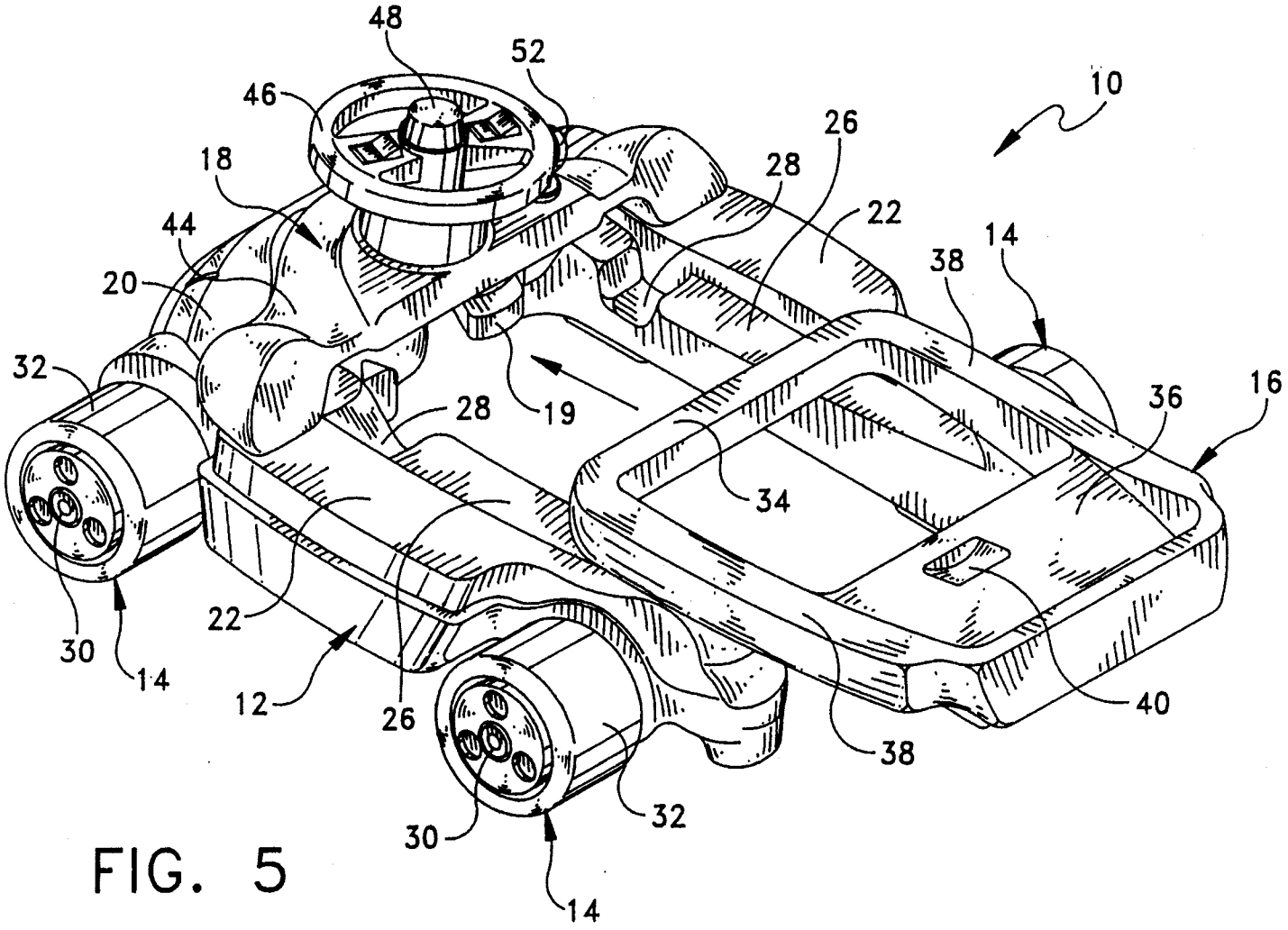
FIG. 5 is a rear perspective view illustrating the assembly of the frame member into the second position thereof.
Figure 6:
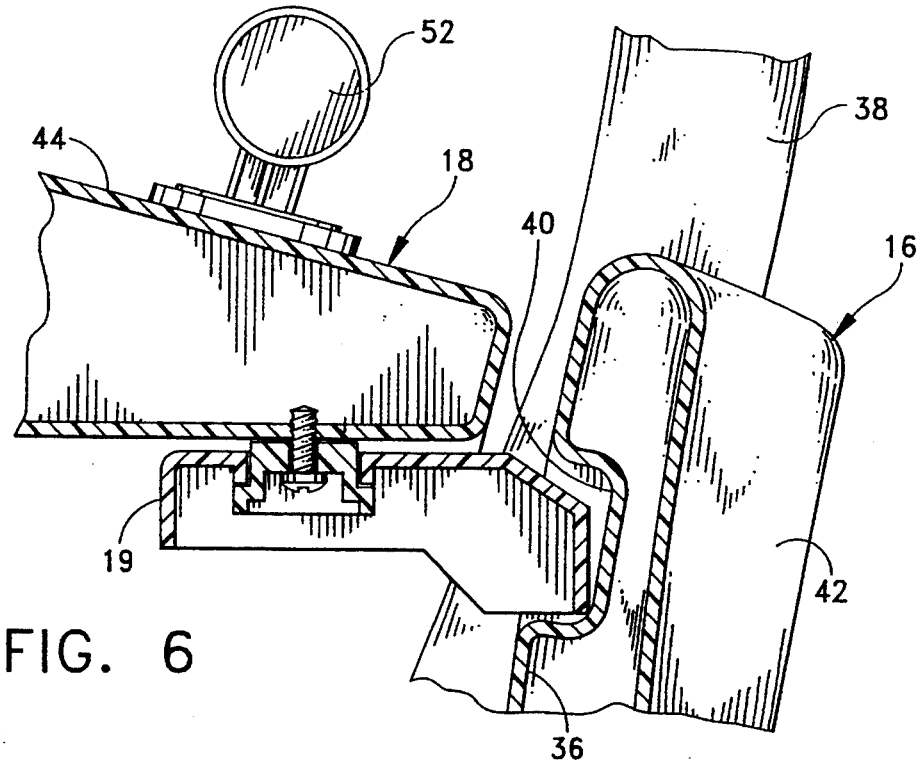
FIG. 6 is a sectional view taken along line 6—6 in FIG. 1.
Figure 7:
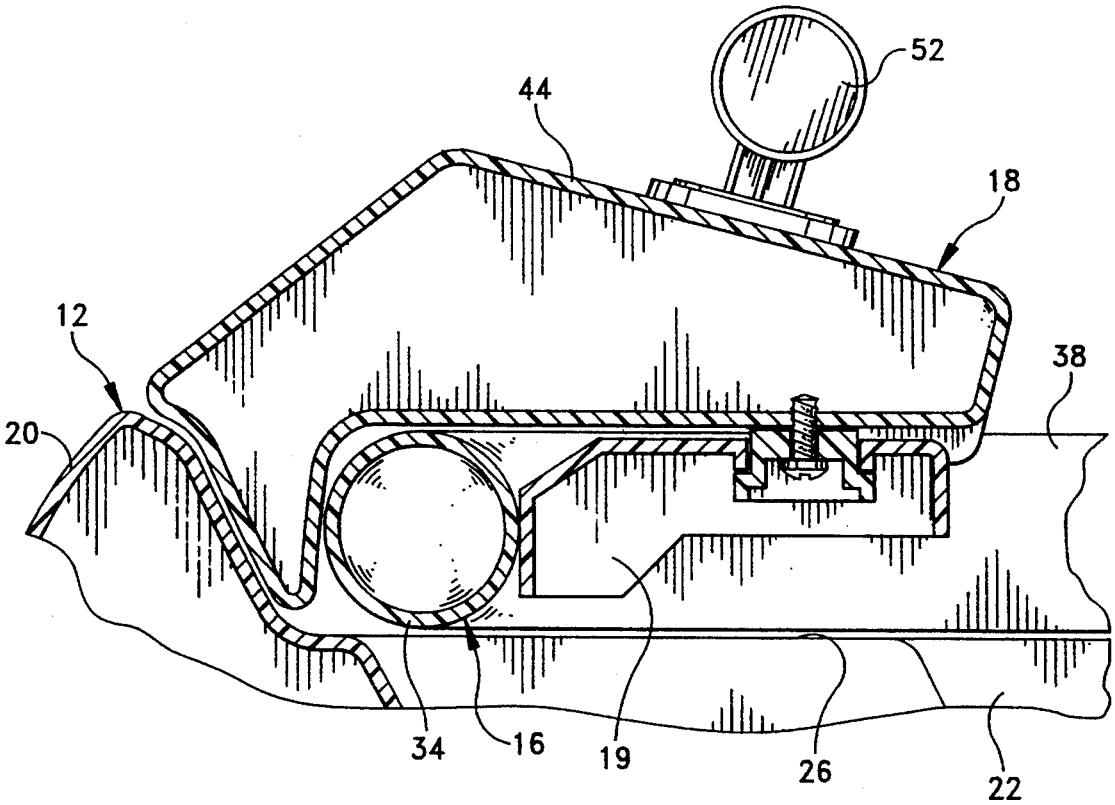
FIG. 7 is a sectional view taken along line 7—7 in FIG. 2.

As previously noted, the frame member 16 is adapted to be alternatively assembled with the chassis 12 in the first position thereof illustrated in FIGS. 1, 3 and 4, or the second position thereof illustrated in FIGS. 2 and 5. When the frame member is 16 is assembled with the chassis 12 in the first position thereof, the seat portion 36 is positioned adjacent the base portion 20, and the adjacent portions of the connector portions 38 are received in the forward recesses 28 in the forward end portions of the legs 22. When the frame member 16 is in this position, the seat portion 36 engages the rear extremity of the dashboard member 44, and the latch member 19 is pivotable to the position of engagement in the locking recess 40 illustrated in FIG. 6 for retaining the frame member 16 in the first position thereof. As will be readily apparent from FIG. 1, when the frame member 16 is in the first position thereof, the combination walker/vehicle of the instant invention can be effectively utilized as a walker for supporting a child during the development of walking skills. Specifically, a child received in the open area 24 can grasp the handle bar portion 34 to assist and steady the child during a walking activity.

In order to assemble the frame member 16 with the chassis 12 for use of the combination walker/vehicle as a toy ride-on vehicle, the latch member 19 is pivoted to a position of disengagement from the locking recess 40 and the frame member 16 is removed from the chassis 12. Thereafter, as illustrated in FIG. 5, the frame member 16 is positioned in a substantially horizontal disposition in which the recess 40 faces upwardly and the support members 42 face downwardly. The frame member 16 is then advanced forwardly into the chassis 12 so that the connector portions 38 are received in the recesses 26 and so that the handle bar portion 34 is received beneath the dashboard member 44. The locking member 19 can then be pivoted to the second retaining position illustrated in FIG. 7 in which the locking member 19 engages the rear side of the handle bar portion 34 to prevent the frame member 16 from being removed from the chassis 12 in a rearward direction. Further, because of the configuration of the frame member 16 and the fact that the handle bar portion 34 is actually received beneath the dashboard member 44, the locking member 19 effectively prevents the removal of the frame member 16 from the chassis 12 in any direction. As will be readily apparent from FIG. 2, when the frame member 16 is assembled in the second position thereof, the seat portion 36 extends between the rear portions of the legs 22 to provide a convenient seat for a child. Further, the open area between the seat portion 36 and the handle bar portion 34 on the frame member 16 provides an effective open area for receiving the legs of a child so that the toy vehicle formed with the chassis 12 and the frame member 16 can be propelled along a supporting surface by the child's feet.

It is seen, therefore, that the instant invention provides an effective combination walker/vehicle. The apparatus 10 is adapted so that the frame member 16 can be effectively and easily assembled with the chassis 12 in either of the first or second positions thereof to provide an effective walker or an effective foot-to-floor ride-on vehicle. Further, the dashboard assembly 18 includes various accessories, including the steering wheel 46, the horn 48, the turn signal indicator 50, and the ignition switch 52 to enhance the overall appeal of the combination walker/vehicle 10. Hence, it is seen that the combination walker/vehicle 10 represents a significant improvement in the related art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible walker/vehicle for a child comprising:

a. a chassis of generally U-shaped configuration including a pair of spaced opposite leg portions and a base portion extending therebetween, said chassis having an open interior area between said leg portions and an open end, said base portion and said open end defining opposite front and rear ends of said chassis, respectively;

b. wheel means for movably supporting said chassis on a supporting surface;

c. a frame member including spaced transversely extending handle bar and seat portions and at least one connector portion extending therebetween;

d. first securing means for securing said frame member to said chassis in a first position in which said connector portion extends upwardly from said chassis for positioning said handle bar portion in upwardly spaced transverse relation thereto; and e. second securing means for alternatively securing said frame member to said chassis in a second position in which said seat portion extends transversely between said opposite leg portions in rearwardly spaced relation to said base portion for supporting a child on said seat portion.

2. In the convertible walker/vehicle of claim 1, said first securing means securing said frame member to said chassis so that said connector portion extends upwardly from said base portion.

3. In the convertible walker/vehicle of claim 1, said frame member including a pair of spaced longitudinally extending connector portions which define opposite side extremities of said frame member.

4. In the convertible walker/vehicle of claim 3, said handle bar and seat portions being in spaced relation and cooperating with said connector portions for defining an enlarged open area in said frame member.

5. In the convertible walker/vehicle of claim 3, said seat portion being disposed adjacent said base portion when said frame member is in the first position thereof and being disposed adjacent the rear end of said chassis when said frame member is in the second position thereof.

6. In the convertible walker/vehicle of claim 5, said seat portion having a recess formed therein, said first securing means including a latching member which is releasably receivable in said recess for retaining said frame member in the first position thereof.

7. In the convertible walker/vehicle of claim 5, said first securing means including inwardly facing first recesses on said legs adjacent said base portion for receiving said connector portions therein so that said frame member is maintained in an upwardly extending disposition relative to said chassis.

8. The walker/vehicle of claim 1 further comprising a simulated dashboard and steering wheel on said base portion.

9. In the walker/vehicle of claim 3, said second securing means including upwardly facing recesses on said leg portions for receiving said connector portions so that said frame member is maintained in a substantially horizontal disposition on said chassis.

* * * * *